US006287448B1

(12) United States Patent
Schierle-Arndt et al.

(10) Patent No.: US 6,287,448 B1
(45) Date of Patent: Sep. 11, 2001

(54) ELECTROCHEMICAL PRODUCTION OF LITHIUM USING A LITHIUM AMALGAM ANODE

(75) Inventors: Kerstin Schierle-Arndt, Mannheim; Hermann Pütter, Neustadt; Günther Huber; Dieter Schläfer, both of Ludwigshafen; Josef Guth, Freinsheim, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/531,471

(22) Filed: Mar. 20, 2000

(30) Foreign Application Priority Data

Mar. 29, 1999 (DE) ..... 199 14 221

(51) Int. Cl.[7] ..... C25C 1/00

(52) U.S. Cl. ..... 205/560; 204/220; 204/221; 204/250; 205/528

(58) Field of Search ..... 205/407, 560–614, 205/528; 204/220, 221, 250

(56) References Cited

U.S. PATENT DOCUMENTS 4,042,482 * 8/1977 Shannon et al. ..... 204/242
4,089,770 * 5/1978 Lemke ..... 204/247
4,156,635 * 5/1979 Cooper et al. ..... 205/407
5,951,843 * 9/1999 Itoh et al. ..... 205/560

FOREIGN PATENT DOCUMENTS 0 497 410 8/1992 (EP) .
1155927 1/1968 (GB) .

OTHER PUBLICATIONS

Cooper et al. "Development of Bipolar Cell for Lithium Production" Electrochemical Society Proceedings vol. 95–11 (1995) pp. 280–290.

* cited by examiner

*Primary Examiner*—Kathryn L. Gorgos
*Assistant Examiner*—Wesley A. Nicolas
(74) *Attorney, Agent, or Firm*—Keil & Weinkauf

(57) ABSTRACT

A process for producing metallic lithium starting from an aqueous solution of at least one lithium salt comprises the following steps:

(I) Production of a lithium amalgam from an aqueous solution of at least one lithium salt; and (II) Electrolysis using an anode comprising the lithium amalgam, a solid electrolyte which conducts lithium ions, and liquid lithium as cathode, wherein the lithium amalgam as anode is kept in motion.

8 Claims, 4 Drawing Sheets

ELECTROCHEMICAL PRODUCTION OF LITHIUM USING A LITHIUM AMALGAM ANODE

The present invention relates to an improved process for the electrochemical production of metallic lithium from aqueous lithium salt solutions which makes, inter alia, simplified recycling of lithium possible.

The invention also describes an electrolysis cell for implementing this process and describes the principle of a production plant.

Lithium is an important basic inorganic chemical and has a number of applications. Thus, it is used for preparing organolithium compounds, as alloying addition to aluminum or magnesium and for lithium batteries. Lithium is produced industrially by melt electrolysis of a eutectic mixture of lithium chloride and potassium chloride at from 400 to 460° C. (Ullmann's Encyclopedia of Industrial Chemistry, Sixth Edition, 1998 Electronic Release).

This process has a high energy consumption (28–32 kWh/kg of Li). In addition, the process has the serious disadvantage that only anhydrous lithium chloride can be used. The lithium chloride available primarily as an aqueous solution therefore has to be converted into the anhydrous solid in an energy-intensive process. Since lithium chloride is hygroscopic, drying and handling is particularly difficult.

U.S. Pat. No. 4,156,635 and J. F. Cooper et al., Proc. Electrochem. So. 1995, 95-11, 280–290 describe a process for the electrochemical production of lithium from an aqueous lithium salt solution using a lithium amalgam electrode. In this process, a lithium salt solution, in particular a lithium hydroxide solution, is electrolyzed using an amalgam cathode. Electrolysis forms lithium amalgam which is made the anode in a second electrolysis cell. Lithium cathode and amalgam anode are separated by means of boron nitride seals. In this second electrolysis cell, a 2 cm salt melt of 2 alkali metal iodides serves as electrolyte (preferably LiI and CsI or LiI and KI), while lithium metal is produced at the cathode. The current density is from 1 to 4 $kA/m^2$, without mass transfer limitation occurring. In the recovery of lithium from the amalgam by this method, a current yield of only 81–87% is achieved. A particularly serious problem is that the lithium obtained is contaminated with mercury, since the mercury can diffuse through the electrolyte.

EP-B 0497410 describes a process for altering the concentration of lithium in a liquid metal from the group aluminum, copper, zinc, tin and lead by electrochemical means. Here, use is made of an electrochemical cell comprising the liquid metal and an electrically conductive material which can absorb lithium. Between these two there is a dry electrolyte which can conduct Li ions and other alkali metal ions. A DC voltage is then applied so that lithium ions and other ions of main group I migrate from the liquid metal through the dry electrolyte and are absorbed by the electrical conductor. The liquid metal is made the anode, and the conductive material on the other side of the dry electrolyte is made the cathode. The following dry electrolytes are used: $\beta$-$Al_2O_3$, $\beta''$-$Al_2O_3$, mixture of $Na_2O$ and $Al_2O_3$, NASICON and bismuth or a bismuth alloy.

GB-B 1,155,927 describes a process in which sodium metal can be isolated from sodium amalgam by electrochemical means using a solid sodium ion conductor, e.g. $\beta$-$Al_2O_3$, with amalgam as anode and sodium as cathode. However, when applied to lithium, the process described in GB-B 1,155,927 does not lead to the results described there in respect of lithium conversion, product purity and current density. Furthermore, the system described is unstable over the course of a few days if the temperature range claimed is adhered to.

It is an object of the present invention to find an improved process for the electrochemical production of lithium from aqueous solutions of at least one lithium salt via lithium amalgam which allows more energetically favorable production of lithium than does the melt electrolysis used hitherto.

For this purpose, the process described in U.S. Pat. No. 4,156,635 and J. F. Cooper et al., Proc. Electrochem. Soc. 1995, 95-11, 280–290, is to be altered so that the problems described above are eliminated and the process can be carried out on an industrial scale. This also makes it necessary to achieve a higher current yield than that reported in U.S. Pat. No. 4,156,635 and J. F. Cooper et al., Proc. Electrochem. Soc. 1995, 95-11, 280–290. The process described in GB-B 1,155,927 should therefore be decisively improved for the recovery of lithium from amalgam.

In such an improved process, the following essential requirements have to be met:

The process should start from the lithium salt solutions which are customarily used on an industrial scale and are obtained, for example, by dissolving lithium carbonate in aqueous hydrochloric acid solution. It should also be possible to make use of Li salt solutions which are obtained as waste streams, for example in the synthesis of organolithium compounds. The lithium metal has to be obtained primarily in such a purity that further process steps are unnecessary. This requires a heavy metal content of less than 1 ppm in the lithium. The process should be able to be implemented on an industrial scale and therefore has to make sufficiently high current densities and space-time yields possible.

The present invention accordingly provides a process for producing metallic lithium starting from an aqueous solution of at least one lithium salt, which comprises the following steps:

(I) Production of a lithium amalgam from an aqueous solution of at least one lithium salt; and (II) Electrolysis using an anode comprising the lithium amalgam, a solid electrolyte which conducts lithium ions, and liquid lithium as cathode, wherein the lithium amalgam as anode is kept in motion.

The term "lithium amalgam" refers to a solution of lithium in mercury which is liquid at the reaction temperature.

The novel process can be implemented in a manner analogous to an integrated chloralkali electrolysis process by the amalgam method, as exists at present.

Furthermore, the present invention provides a process in which lithium waste, e.g. that from batteries and reaction solutions, can be re-used or used as starting materials for producing the aqueous lithium salt solutions used according to the present invention. For example, organolithium reactions produce appreciable amounts of lithium halides in the form of aqueous solutions. Likewise, aqueous solutions of various lithium salts, e.g. lithium halides, lithium sulfate, lithium sulfonates or lithium salts of organic acids, can be recovered, e.g. leached out, from lithium ion batteries. A further possibility for the recovery of such lithium salt solutions is the acid digestion of the electrolytes and electrodes used in batteries, for example by means of hydrochloric acid or sulfuric acid. In a preferred embodiment, the lithium waste is converted, for example, into an aqueous lithium chloride solution by means of hydrochloric acid.

In the first step of the coupled process of the present invention, the aqueous Li salt solution is electrolyzed in a chloralkali amalgam cell. This forms chlorine at the anode, if lithium chloride solutions are used. The chlorine is, in a manner typical of such a process, conducted away, purified and passed to customary uses. The process proceeds analogously to the isolation of chlorine from sodium chloride by the amalgam process (Ullmann's Encyclopedia of Industrial Chemistry, $6^{th}$ Edition, 1998 Electronic Release). In the case of lithium sulfates, oxygen is given off at the anode. The electrolysis solution then has to be maintained at a pH in the range from 2 to 4 by means of Li salts which provide base.

The cathode process converts the lithium into reduced metallic form in the liquid amalgam. Mercury or amalgam flows along the bottom of the electrolysis cell as cathode. A lithium chloride solution containing from 220 to 350 g/l of lithium chloride flows over the mercury. The chlorine formed at the anode and the depleted lithium chloride solution (160–210 g/l) are discharged from the cell. The lithium content of the amalgam is maintained at from 0.02 to 0.19% by weight (about 0.5–5 atom %), preferably from 0.04 to 0.1% by weight (about 1–3 atom %) so that the amalgam remains fluid. The outflowing amalgam is advantageously conducted over a weir. Titanium is generally used as anode, but graphite is likewise possible. Current densities of up to 10 $kA/m^2$ are possible in this way. The cell voltage is U=4–5 V. The current yield is >90% (based on chlorine), generally from 95 to 97%. The reaction temperature is from 50 to 100° C., preferably from 70 to 90° C.

The removal of the chlorine and the handling of mercury correspond to the standard achieved in chloralkali electrolysis.

In the process of the present invention, the anode potential is maintained at such a level that only lithium is oxidized at the anode and the ion is transported through the solid electrolyte in the electric field and is finally reduced to lithium at the cathode.

In addition, the present application is accompanied by the following figures:

Figure 1:
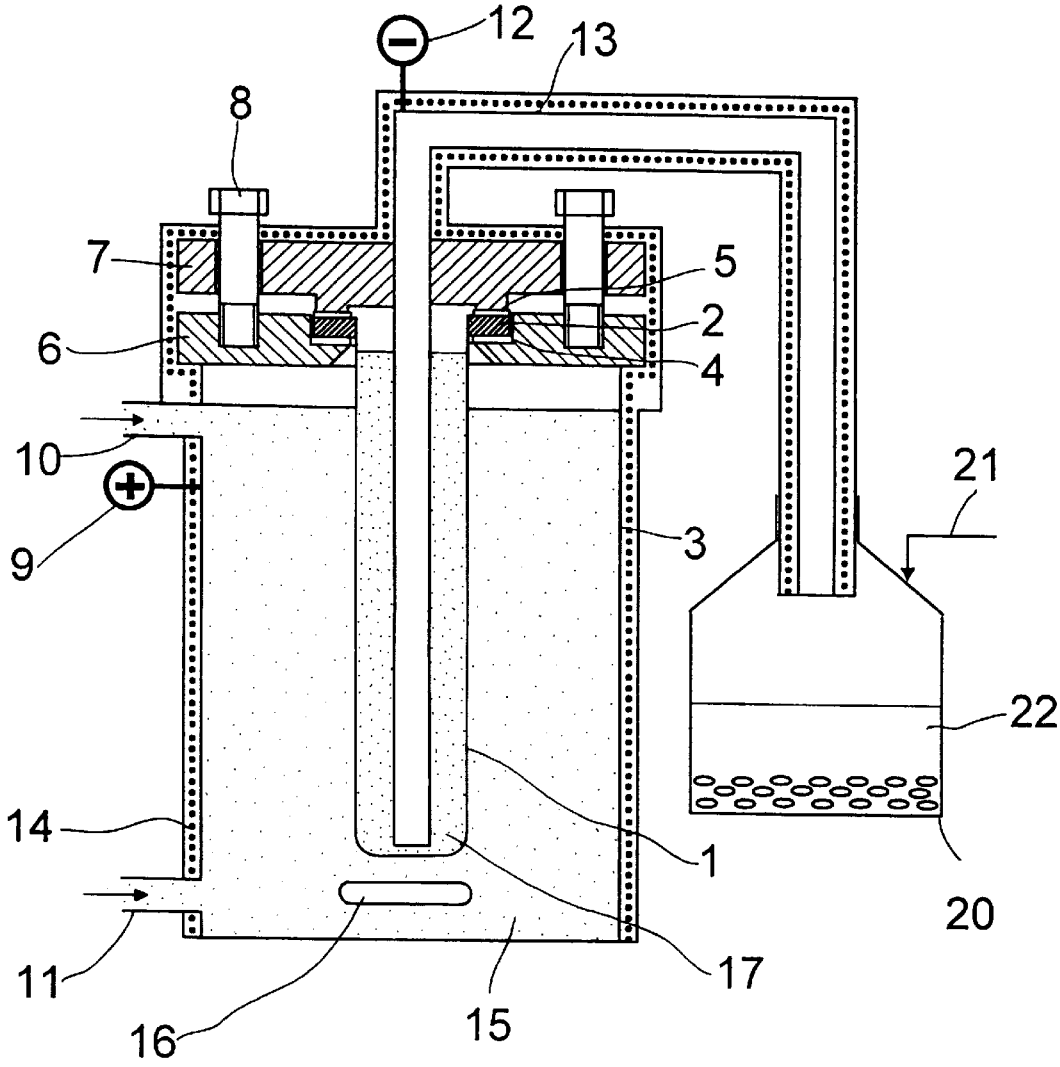
FIG. 1: shows a schematic view of an electrolysis cell which can be used for the second step of the process of the present invention and includes a stirrer.

The $2^{nd}$ step of the process of the present invention is carried out in an electrolysis cell having a liquid lithium amalgam anode which is kept in motion. This is a liquid anode which is kept in motion and whose lithium content is depleted during operation, so that it is replaced by lithium-richer amalgam which can be obtained, for example, in an electrolysis for producing lithium amalgam and chlorine from lithium chloride.

This can be achieved in a technically simple manner since the liquid amalgam can be conveyed without problems. In the first step, the concentrated amalgam outflow is generally passed over a weir in order to separate off the aqueous lithium chloride solution. Subsequently, the amalgam stream is heated in a heat exchanger to the operating temperature of the process of the present invention and is fed to the hot liquid anode which is kept in motion. This is advantageously carried out in a countercurrent heat exchanger so that hot outflowing depleted amalgam heats the feed.

The replacement of depleted amalgam can be carried out either batchwise or continuously. The batchwise procedure achieves higher lithium concentrations, averaged over the batch. However, the continuous procedure is simpler to carry out in terms of production operation. The disadvantage that the inflowing concentration is generally diluted with circulated depleted lithium amalgam can be compensated by carrying out the process in a plurality of stages.

The liquid anode is advantageously kept in motion by stirring and/or by means of a pump in a circuit under atmospheric pressure or slightly superatmospheric pressure. The motion caused by the conversion-related replacement of amalgam or thermal convention is negligible compared to the motion required in the process of the present invention and is not sufficient to achieve the preferred current densities.

If the liquid anode is, as described in GB-B 1,155,927, operated without being kept in motion, it is only possible to achieve current densities of from 20 to 50 $A/m^2$. An increase in the cell voltage enables the current density to be increased only insignificantly because the resistance of the cell increases with increasing current density. Surprisingly, current densities of from 250 to 2000 $A/m^2$ are achieved at moderate cell voltages, i.e. cell voltages in the range from 0.9 to 3.5 volt, when the anode is kept in motion. This is carried out by means of stirring, for example by sparging in of gas or by means of a mechanical stirrer, or using a pump. Preference is given to motion in the form of forced flow as can be achieved, for example, using an amalgam circuit driven by a pump.

Electric power is advantageously supplied to the anode side via the stainless steel housing of the electrolysis cell which is stable under the reaction conditions. The anode side is electrically insulated from the cathode side in an appropriate manner.

The cathode comprises lithium which is in liquid form at the temperatures required for stabilizing the anode process. When assembling the electrolysis cell, the lithium is preferably introduced in the form of a solid reservoir into the cathode chamber. At the beginning of the electrolysis, the lithium is then melted. However, the lithium can also be introduced in liquid form into the cathode chamber at the beginning of the electrolysis. The lithium formed in the process of the present invention can, in a technically simple manner, be discharged from the cathode chamber via an overflow. The lithium flow is throttled to ensure that the pressure on the lithium side is higher than the pressure on the amalgam side. This suppresses potential mercury contamination of the lithium product via micropores or other leaks. The overpressure of the cathode relative to the anode is from 0.1 to 5 bar, preferably from 0.5 to 1 bar, in the process of the present invention.

Electric power is advantageously supplied to the cathode via the lithium charge and the outflow pipes or connection flanges.

The anode and cathode chambers are separated from one another by means of a solid electrolyte which conducts lithium ions and is impermeable to helium. Ceramic materials or glasses are useful for this purpose.

The ion conductors preferably fulfil the following conditions:

1. The iron conductors have good $Li^+$ ion conductivity at the reaction temperature ($\sigma$>0.005 S/cm).
2. The ion conductors are stable to liquid lithium and liquid lithium amalgam.
3. The ion conductors have a negligibly low electron conductivity.

The following solid electrolytes are particularly suitable:

1. Li-β"-$Al_2O_3$ or Li-β-$Al_2O_3$ which can be prepared from Na-β"-$Al_2O_3$ or from Na-β-$Al_2O_3$ by replacement of the sodium ions by lithium ions. (O. Schäf, T. Widmer, U. Guth, Ionics 1997, 3, 277–281.)
2. Lithium analogs of NASICON ceramics which comprise an $[M_2(PO_4)_3]^-$ network, where M=Zr, Ti, Ge, Hf. They have the general composition $Li_{1-x}M_{2-x}A_x(PO_4)_3$ or $Li_{1-x}M_{2-x}M'_x(PO_4)_3$, where M=Zr, Ti, Ge, Hf; A=Nb, Ta; In, Sc, Ga, Cr, Al (A. D. Robertson, A. R. West, A. G. Ritchie, Solid State Ionics 1997, 104, 1–11 and the literature cited therein)
3. LISICONS which have a $\gamma_{II}$-$Li_3PO_4$ structure and the composition $Li_{2+2x}Zn_{1-x}GeO_4$, where −0.36<x<+0.87, or $Li_{3+x}Y_{1-x}X_xO_4$, where X=Si, Ge, Ti and Y=P, V, Cr (A. D. Robertson, A. R. West, A. G. Ritchie, Solid State Ionics 1997, 104, 1–11 and the literature cited therein).
4. Lithium ion conductors having a perovskite structure and the composition $Li_{0.5-3x}La_{0.5+x}TiO_3$ or $Li_{0.5-3x}Ln_{0.5+x}TiO_3$ (A. D. Robertson, A. R. West, A. G. Ritchie, Solid State Ionics 1997, 104, 1–11 and the literature cited therein, EP 0 835 951 A1).
5. Sulfidic glasses (R. Mercier, J. P. Malugani, B. Fahys, G. Robert, Solid State Ionics 1981, 5, 663–666; U.S. Pat. No. 4,465,746; S. Sahami, S. Shea, J. Kennedy, J. Electrochem. Soc. 1985, 132, 985–986)

Figure 3:
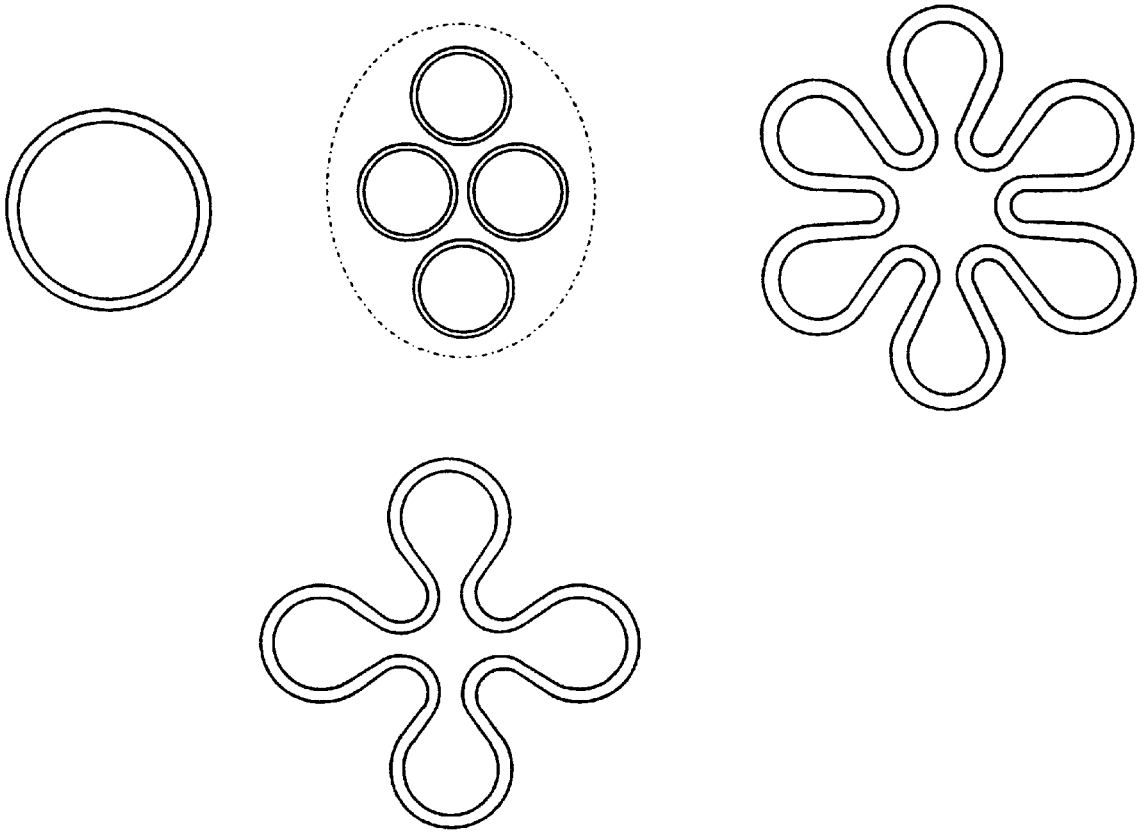
FIG. 3: schematically shows preferred cross-sectional shapes of the solid electrolyte used according to the present invention.

However, preference is given to lithium-β"-aluminum oxide, lithium-β-aluminum oxide and lithium-β/β"-aluminum oxide which can each be prepared from sodium-β"-aluminum oxide, sodium-β-aluminum oxide or sodium-β/β"-aluminum oxide by cation exchange. Preference is likewise given to lithium analogs of NASICON ceramics. The solid electrolyte is advantageously in the form of a thin-walled but nevertheless pressure-resistant tube which is closed at one end (EP-B 0 424 673) and has an electrically insulating ring fitted to its open end by means of a helium-tight, likewise electrically insulating glass solder joint (GB 2 207 545, EP-B 0 482 785). The wall thickness of the electrolyte which conducts lithium ions is from 0.3 to 5 mm, preferably from 1 to 3 mm, particularly preferably from 1 to 2 mm. The cross-sectional shape of the tube closed at one end is circular in the preferred embodiment, while cross-sectional shapes having an enlarged surface area which can be derived, for example, from a combination of a plurality of circular surfaces as shown in FIG. 3, are used in a further embodiment. It is important to the process of the present invention for the solid electrolyte which conducts lithium ions to be free of leaks since mercury can only get into the lithium product via leaks in the solid electrolyte or sealing system because the anode potential in the process of the present invention is set so that formation of mercury ions is ruled out. Use is generally made of solid electrolytes which have leakage rates of less than $1*10^{-9}$ mbar*liter*$sec^{-1}$ in a helium leak test, i.e. are helium-tight to within the detection limit.

Furthermore, the releasable sealed connections are preferably designed so that lithium and amalgam are each sealed from the surrounding atmosphere. Releasable seals between lithium and amalgam are avoided where possible, because the releasable seals may well be impermeable to liquid but are generally not gastight and would then enable mercury vapor to diffuse through the releasable seal and cause undesirable contamination of the lithium. In a preferred embodiment, the releasable seal connections used are flat seals, preferably of graphite, for example unreinforced GRAPHIFLEX® or reinforced high-pressure SIGNAFLEX® from SGL Carbon. In a preferred embodiment, an inert gas such as argon or nitrogen flows around the seals in order to prevent diffusion of oxygen. Heliumim-permeable electrolytes and the sealing arrangement described enable residual mercury contents of from 0.05 to 0.3 ppm in the lithium to be obtained.

FIG. 1 shows a typical experimental setup:

In a manner similar to that described for sodium in GB 1,15,927, the cell has in its middle a tube 1 which is closed at one end and is made of a solid electrolyte which conducts lithium ions. However, the wall thickness of the tube is preferably 1–3 mm, instead of the 5 mm described. A ring of nonconductive material 2 is fitted to the open end by means of a glass solder joint so as to be impermeable to helium. By means of this ring, the tube which conducts lithium ions is installed and sealed with the opening upward in a cylindrical container 3 made of austenitic stainless steel 1.4571. For this purpose, the ring 2 was clamped with a flat seal below 4 and above 5 between the housing 6 and the cover flange 7 by means of three clamping screws 8.

An anode power lead 9 is attached to the stainless steel container. A pipe connection 10 is welded on at the side near the top for feeding in amalgam and a pipe connection 11 is welded on at the side near the bottom for the outflow. From the cover flange, a stainless steel tube 13 projects as cathodic power lead 12 into the opening of the tube which conducts lithium ions. The same tube 13 passes through the cover flange and has an outlet for liquid lithium at the side near the top. The entire apparatus is heated (14).

The anode is the amalgam charge 15 between the housing and the outer wall of the solid electrolyte tube which conducts lithium ions. The anode is continually agitated by means of the magnetic stirrer 16. The cathode 17 is the liquid lithium charge within the solid electrolyte tube which conducts lithium ions. The liquid lithium formed is discharged via the heated outlet tube into a vessel 20 which is partly filled with an inert liquid 22 and is maintained under inert conditions, e.g. by means of argon 21.

When the solid electrolyte which conducts lithium ions is used for the first time, one frequently observes a relatively high ceramic resistance which remains at an unchanged high level during the course of further operation. The resistance of the solid electrolyte can be up to a factor of 15 higher than the achievable values. This is presumably attributable to the lack of reactivity of the surface.

A lowering of the ceramic resistance can be achieved by conditioning of the ceramic:

The ceramic resistance can be significantly reduced, for example, by first operating the cell under reverse polarity, i.e. the anode is first operated as cathode. In this case, the cathode can comprise lithium amalgam, as the anode otherwise does. The current density in the reverse-polarity state is increased linearly from 50 $A/m^2$ to 1000 $A/m^2$ over a time of from 1 to 44 hours, preferably from 2 to 6 hours.

The smallest ceramic resistances are obtained when, on start-up, liquid lithium is first used as anode for from 1 to 24 hours at an operating temperature of from 250° C. to 350° C. and this is then replaced by amalgam. This method of conditioning is particularly preferred.

During operation of the process of the present invention, the action of water vapor on the ceramics which conduct lithium ions likewise has to be ruled out at all costs. In general, this is achieved by heating the amalgam containing traces of water, removing the water vapor and only then feeding the water-free amalgam/mercury mixture to the liquid anode. The removal of the water vapor is advantageously aided by stripping with inert gas or by application of subatmospheric pressure.

The current density is generally from 0.3 to 10 $kA/m^2$, preferably from 0.5 to 3 $kA/m^2$. The current density is set in a targeted manner at the external power source, generally a mains rectifier.

Figure 4:
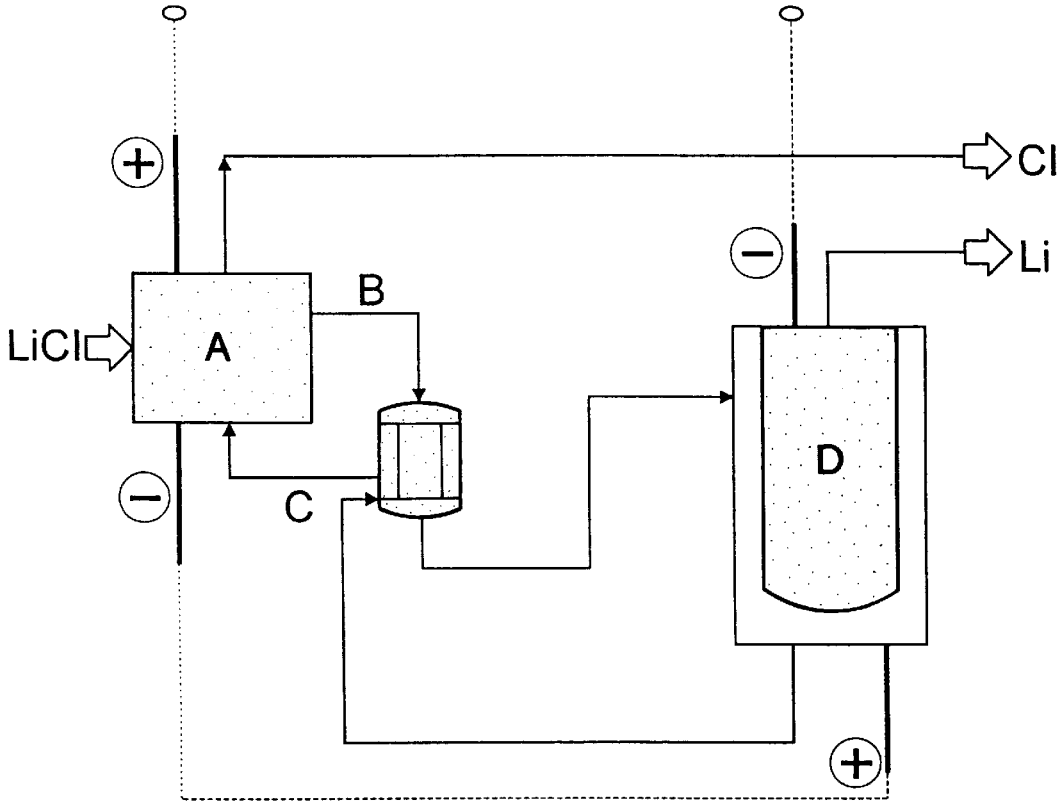
FIG. 4: shows a schematic flow diagram of the process of the present invention.

In a particular embodiment, the electrolysis cell used in the second step of the process of the present invention is integrated into the power supply to the amalgam-producing chlorine cell of the first step, so that an additional mains rectifier can be omitted (FIG. 4).

In a preferred embodiment, the ceramic which conducts lithium ions is configured as a tube which is closed at one end and is installed concentrically in the interior space of a larger external tube. The external tube consists of a material which is very impermeable and is resistant to hot amalgam. Particularly suitable materials are stainless steel and graphite. The liquid anode flows in a longitudinal direction through the annular gap between the external tube and the ceramic tube. The width of the annular gap is advantageously from 1 to 10 mm, preferably from 2 to 5 mm, particularly preferably from 2.5 to 3 mm. The flow velocity is from 0.03 to 1.0 m/s, preferably from 0.05 to 0.6 m/s, particularly preferably from 0.1 to 0.3 m/s. A higher flow velocity generally allows higher current densities. A further advantage resulting from the anode being configured as an annular gap is the relatively small ratio of anode volume to anode area. This makes it possible to meet the requirement of moderate apparatus weights and an acceptable mercury circulation.

Figure 2:
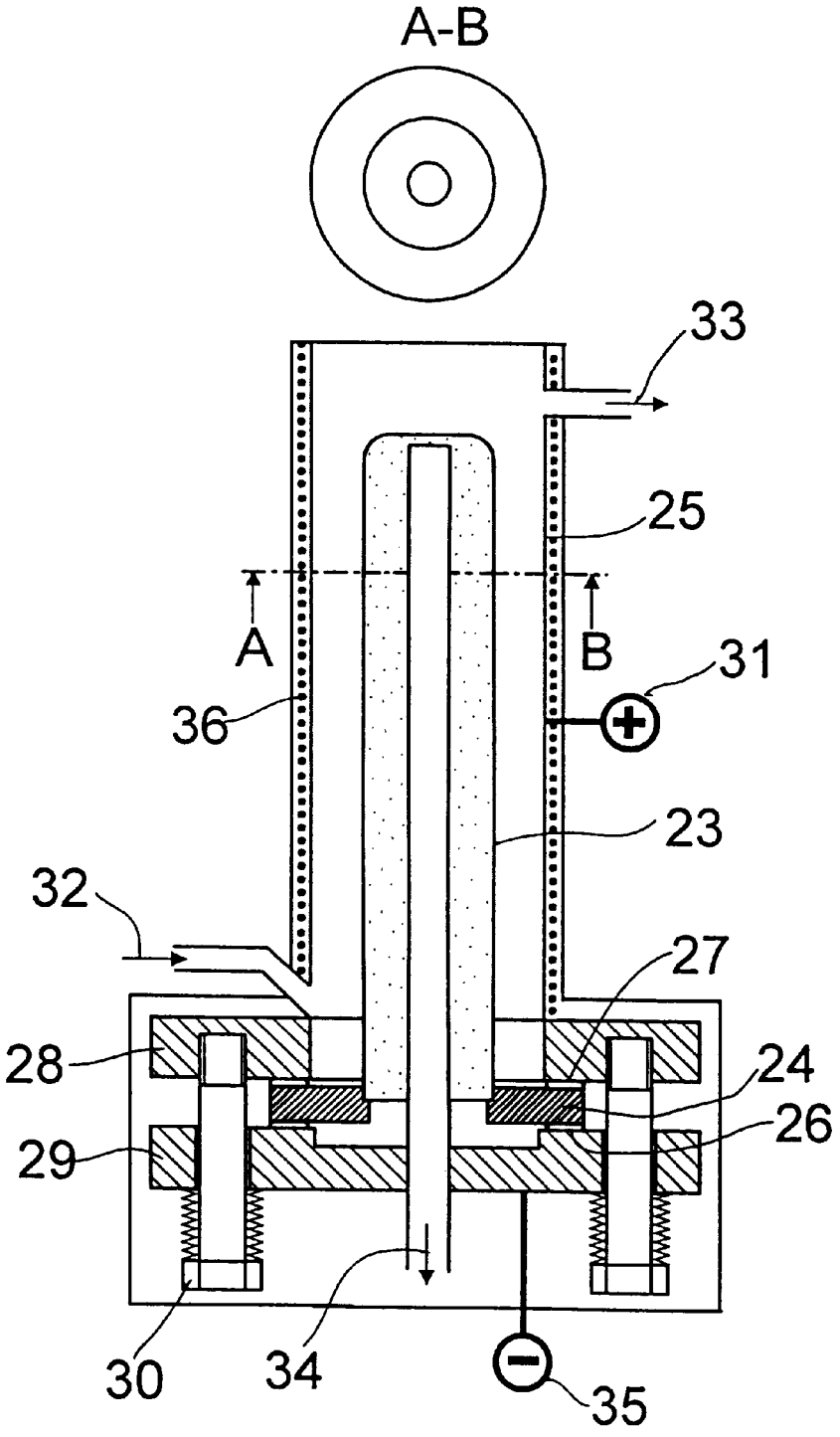
FIG. 2: shows a schematic view of an electrolysis cell which can be used in the $2^{nd}$ step of the process of the present invention and comprises a tubular solid electrolyte closed at one end which is installed in a concentric stainless steel tube.

FIG. 2 shows a typical embodiment:

The cell has in its middle a tube 23 which is closed at one end and is made of the solid electrolyte which conducts lithium ions. At the open end, a ring of insulating material 24 is fitted in a helium-tight manner by means of a glass solder joint. By means of this ring 24, the tube which conducts lithium ions is installed with the opening downward in a concentric stainless steel tube 25 so that an annular gap of preferably from 2 to 5 mm is formed. The anode space defined by the annular gap and the tube length meets, firstly, the demand for a construction concept which makes do with a relatively small mercury content. Secondly, the annular cross section allows the amalgam anode to flow through the anode space in an axial direction in a manner which is very effective in terms of the current density. To seal the unit, the ring 24 is clamped with a flat seal below 26 and above 27 between the housing 28 and the cover flange 29 by means of three or four clamping screws 30.

An anode power lead 31 is attached to the stainless steel container. A pipe section 32 is welded on at the side near the bottom for feeding in amalgam, and a pipe section 33 is welded on at the side near the top for the outflow. From the cover flange, a stainless steel tube 34 projects as cathode power lead 35 into the opening of the solid electrolyte. The same tube 34 passes through the cover flange and serves for the free discharge of liquid lithium. The cell is heated (36).

The anode is the amalgam charge in the annular space between the inner wall of the steel tube and the outer wall of the solid electrolyte tube which conducts lithium ions. The cathode is the liquid lithium charge within the solid electrolyte tube which conducts lithium ions.

The cell voltage is made up essentially of the two following individual contributions: the electrochemical potential of the redox system lithium to lithium amalgam and the ohmic voltage drop across the electrical resistance of the ceramic electrolyte. The cell voltage is thus a function of the current density. The electrochemical potential can be measured in the state without current flow. It is established as a function of the lithium concentration in the liquid anode. At a lithium concentration of 0.05% by weight, for example, a cell voltage of 0.92 V is established in the state in which no current flows. At a current density of 1000 $A/m^2$, for example, a cell voltage of 1.95 V is established.

The cell voltage is monitored and is limited so as to rule out anode potentials at which impurities in the moving anode which are nobler in terms of the electrochemical series could be oxidized.

The value of the cell voltage can be an indicator of mass transfer from the liquid moving anode to the ceramic surface and is generally monitored for this purpose. Mass transfer limitation can be caused by the lithium concentration in the anode being too low and/or by insufficient flow and/or by the current density being too high.

Operation in the region of mass transfer limitation, i.e. at a cell voltage which is too high, can be tolerated for only a short time since operation for a number of days in this limiting current region causes irreversible damage to the ceramic, e.g. loss of conductivity and mechanical embrittlement with crack format ion.

In a preferred mode of operation, the polarity is reversed for from 1 to 10 minutes at intervals of from 1 to 24 hours by short-circuiting anode and cathode via an external resistance. The resistance is calculated so that the current during reversal of polarity is about 1.5 times the current in operation. The yield of lithium product in the process of the present invention is based completely on the lithium reacted at the anode. The current yield of lithium product in normal-polarity operation is 100% to within measurement accuracy. The intermittent reversal of polarity reduces the average current yield to from 95% to 98%.

The amalgam fed to the anode is, in a preferred embodiment, depleted from 0.1% by weight of lithium to 0.03% by weight of lithium. The unreacted lithium is not lost when this step is coupled to a chloralkali electrolysis, because it is returned to the chloralkali cell and comes back from there via the amalgam circuit.

For this purpose, the lithium salt solution is reduced at an amalgam or mercury cathode. Although all aqueous lithium salt solutions can be used in principle, preference is given to using an aqueous lithium chloride solution in conjunction with the chloralkali electrolysis.

We claim:

1. A process for producing metallic lithium starting from an aqueous solution of at least one lithium salt, which comprises the following steps:

(I) Production of a lithium amalgam from an aqueous solution of at least one lithium salt; and (II) Electrolysis using an anode comprising the lithium amalgam, a solid electrolyte which conducts lithium ions, and liquid lithium as cathode, wherein the lithium amalgam as anode is kept in motion.

2. A process as claimed in claim 1, wherein the lithium amalgam as anode is kept in motion by stirring and/or by means of a pump under atmospheric pressure or slightly superatmospheric pressure.

3. A process as claimed in claim 1 carried out at from 250 to 400° C.

4. A process as claimed in claim 1 carried out at current densities above 250 $A/m^2$.

5. A process as claimed in claim 1, wherein the lithium amalgam originates from chloralkali electrolysis.

6. A process as claimed in claim 1, wherein the solid electrolyte is selected from the group consisting of lithium-β"-aluminum oxide, lithium-β-aluminum oxide, lithium-β/β"-aluminum oxide and lithium analogs of NASICON ceramics.

7. A process as claimed in claim 1, wherein the solid electrolyte is conditioned before carrying out the process.

8. A process as claimed in claim 1, wherein the aqueous solution of at least one lithium salt is obtained starting from lithium waste.

* * * * *